US011498198B2

(12) United States Patent
Cook

(10) Patent No.: US 11,498,198 B2
(45) Date of Patent: Nov. 15, 2022

(54) ERGONOMIC HANDLE FOR A POWER TOOL

(71) Applicant: The Boeing Company, Chicago, IL (US)

(72) Inventor: Rebecca Cook, Charleston, SC (US)

(73) Assignee: The Boeing Company, Chicago, IL (US)

( * ) Notice: Subject to any disclaimer, the term of this patent is extended or adjusted under 35 U.S.C. 154(b) by 226 days.

(21) Appl. No.: 16/545,331

(22) Filed: Aug. 20, 2019

(65) Prior Publication Data

US 2021/0053202 A1 Feb. 25, 2021

(51) Int. Cl.
*B25F 5/02* (2006.01)
*B25D 17/04* (2006.01)

(52) U.S. Cl.
CPC ..... *B25F 5/02* (2013.01); *B25D 17/04* (2013.01)

(58) Field of Classification Search
CPC ... B25F 5/02; B25D 17/04; B21J 15/18; B21J 15/02; B21J 15/105
USPC ..... 173/162.1, 162.2
See application file for complete search history.

(56) References Cited

U.S. PATENT DOCUMENTS 1,086,310 A * 2/1914 Thrun ..... B23D 51/01 30/517
2,712,765 A * 7/1955 Knight, Jr. ..... B25G 1/007 81/58.3
3,167,135 A * 1/1965 Wilmer ..... B25C 1/04 173/133
4,038,719 A * 8/1977 Bennett ..... B25G 1/102 473/551
4,281,531 A * 8/1981 Ehmann ..... B21J 15/105 29/243.525
4,730,632 A * 3/1988 Mace ..... A45B 9/02 74/551.9
5,353,474 A * 10/1994 Good ..... B25F 5/006 173/171

(Continued)

FOREIGN PATENT DOCUMENTS

EP 0142650 A2 * 5/1985
WO WO-8802242 A1 * 4/1988

OTHER PUBLICATIONS

Black Powder Inline Pistols price list, https://www.muzzle-loaders.com/pistols/inline-pistols.html, accessed Aug. 20, 2019.

(Continued)

*Primary Examiner* — Robert F Long
(74) *Attorney, Agent, or Firm* — Kunzler Bean & Adamson

(57) ABSTRACT

Disclosed herein is a handle for a tool head. The handle includes a handle region having a first end and a second end. The handle region includes a first region adjacent the first end and adapted to receive a user's thumb and index finger, the first region including a trigger for actuating the tool head. The handle region also includes a second region adjacent the first region that is adapted to receive the user's middle finger and a first portion of the user's palm, and a third region adjacent the second region and adapted to receive the user's ring finger and a second portion of the user's palm. The handle region also includes a fourth region disposed between the third region and the second end that is adapted to receive the user's pinky finger and a third portion of the user's palm.

20 Claims, 6 Drawing Sheets

(56) References Cited

U.S. PATENT DOCUMENTS 5,389,098 A * 2/1995 Tsuruta ..... A61B 17/07207 606/49
5,588,903 A * 12/1996 Pennison ..... B25F 5/006 451/344
5,634,264 A * 6/1997 Dear ..... B21J 15/043 29/812.5
D387,263 S * 12/1997 Bidstrup ..... D8/107
5,697,456 A * 12/1997 Radle ..... B25D 17/043 173/162.2
D396,624 S * 8/1998 Basilius ..... D8/107
6,161,256 A * 12/2000 Quiring ..... B25F 5/006 81/436
6,386,532 B1 * 5/2002 Donovan ..... B25B 5/061 269/25
6,835,199 B2 * 12/2004 McGuckin, Jr ..... A61B 17/068 227/175.1
7,082,658 B1 * 8/2006 Lin ..... B21J 15/043 29/243.525
7,137,542 B2 * 11/2006 Oki ..... B25F 5/006 173/162.1
7,318,486 B2 * 1/2008 Andriolo ..... B25F 5/02 173/42
8,403,076 B2 * 3/2013 Iwakami ..... B25F 5/006 173/210
8,561,716 B2 * 10/2013 Aoki ..... B25D 17/24 173/162.1
8,820,431 B2 * 9/2014 Puzio ..... B23B 31/1072 173/48
9,434,013 B2 * 9/2016 Johnson ..... B25F 5/02
10,493,611 B2 * 12/2019 Ontl ..... B25D 17/24
10,688,614 B2 * 6/2020 Schaer ..... B23Q 11/0092
10,780,563 B2 * 9/2020 Ichikawa ..... B25D 16/006
11,014,224 B2 * 5/2021 Dey, IV ..... F16F 9/535
2003/0094294 A1 * 5/2003 Fritz ..... B25H 3/006 173/171
2003/0146008 A1 * 8/2003 Andriolo ..... B25F 5/02 173/217
2004/0187322 A2 * 9/2004 Bednar ..... B25F 5/02 30/340
2006/0060365 A1 * 3/2006 Kunz ..... H01H 3/20 173/217
2006/0163312 A1 * 7/2006 Viola ..... A61B 17/072 227/19
2010/0012339 A1 * 1/2010 Hahn ..... B25D 17/043 173/162.1
2010/0018734 A1 * 1/2010 Frauhammer ..... B25D 16/006 200/332
2010/0163265 A1 * 7/2010 Hozumi ..... B25B 21/00 173/217
2010/0320252 A1 * 12/2010 Viola ..... A61B 17/068 227/176.1
2011/0031098 A1 * 2/2011 Nagasaka ..... H01H 19/06 200/336
2011/0278346 A1 * 11/2011 Hull ..... A61B 50/30 227/176.1
2011/0297409 A1 * 12/2011 Chen ..... B25F 5/02 173/217
2012/0048585 A1 * 3/2012 Miyazawa ..... B23D 51/00 173/170
2012/0265154 A1 * 10/2012 Criscuolo ..... A61B 17/00491 604/258
2013/0020105 A1 * 1/2013 Cook ..... B23B 45/001 173/170
2013/0319712 A1 * 12/2013 Massler ..... B25D 17/06 173/201
2014/0144663 A1 * 5/2014 Fuchs ..... B25F 5/02 173/217
2014/0144968 A1 * 5/2014 Shelton, IV ..... A61B 17/068 227/175.1
2014/0166727 A1 * 6/2014 Swayze ..... A61B 17/115 227/175.1
2016/0058439 A1 * 3/2016 Shelton, IV ..... A61B 17/105 227/176.1
2016/0106418 A1 * 4/2016 Shi ..... A61B 17/068 227/175.2
2018/0021933 A1 * 1/2018 Cheng ..... B25F 5/02 173/169

OTHER PUBLICATIONS

Hand Tool Ergonomics—Tool Design, Canadian Centre for Occupational Health and Safety, https://www.ccohs.ca/oshanswers/ergonomics/handtools/tooldesign.html, accessed Aug. 20, 2019.

* cited by examiner

ERGONOMIC HANDLE FOR A POWER TOOL

FIELD

This disclosure relates generally to an ergonomic handle, and more particularly to an ergonomic handle for a power tool such as a pneumatically-driven power tool or an electrically-driven power tool.

BACKGROUND

Vehicles, including air-borne vehicles, are frequently assembled by aligning different parts/panels on structures, potentially with other components. Rivets are often used to attach the parts/panels to each other and the structures. Assembly workers use power tools, such as rivet guns, to set the rivets that secure the parts/panels. Current rivet guns are prone to cause injury to the assembly worker for various reasons, including the hand grip not being in line with an output force axis of the power tool, the trigger location causing misfires, the handle shape and size not conforming to ergonomic standards, and the hand grip angle not being suitable for ideal balance of the weight of the tool.

SUMMARY

The subject matter of the present application provides examples of an ergonomic handle for a power tool that overcome the above-discussed shortcomings of prior art techniques. The subject matter of the present application has been developed in response to the present state of the art, and in particular, in response to shortcomings of conventional power tools, and their associated handles.

Disclosed herein is a handle for use with a tool head that defines an output force axis. The handle includes a handle region having a first end and a second end, the handle region defining a handle axis at a non-orthogonal angle to the output force axis. The handle region includes a first region adjacent the first end and adapted to receive a user's thumb and index finger, the first region including a trigger for actuating the tool head, and where the first region is substantially coaxial with the output force axis. The handle region also includes a second region adjacent the first region and adapted to receive the user's middle finger and a first portion of the user's palm. The handle region also includes a third region adjacent the second region and adapted to receive the user's ring finger and a second portion of the user's palm. The handle region also includes a fourth region disposed between the third region and the second end, and adapted to receive the user's pinky finger and a third portion of the user's palm. The preceding subject matter of this paragraph characterizes example 1 of the present disclosure.

The first region also includes a rearward concave surface. The preceding subject matter of this paragraph characterizes example 2 of the present disclosure, wherein example 2 also includes the subject matter according to example 1, above.

The trigger is coupled with a forward surface of the first region. The preceding subject matter of this paragraph characterizes example 3 of the present disclosure, wherein example 3 also includes the subject matter according to example 2, above.

The second region includes a rearward convex surface. The preceding subject matter of this paragraph characterizes example 4 of the present disclosure, wherein example 4 also includes the subject matter according to any one of examples 1-3, above.

The third region includes a rearward convex surface. The preceding subject matter of this paragraph characterizes example 5 of the present disclosure, wherein example 5 also includes the subject matter according to any one of examples 1-4, above.

The fourth region includes a forward concave surface. The preceding subject matter of this paragraph characterizes example 6 of the present disclosure, wherein example 6 also includes the subject matter according to any one of examples 1-5, above.

The handle also includes a bridge region that defines a bridge axis extending forward from the first end. The bridge axis is at a non-orthogonal angle to the handle axis. The preceding subject matter of this paragraph characterizes example 7 of the present disclosure, wherein example 7 also includes the subject matter according to any one of examples 1-6, above.

The bridge axis is substantially parallel with the output force axis. The preceding subject matter of this paragraph characterizes example 8 of the present disclosure, wherein example 8 also includes the subject matter according to example 7, above.

A distance between the output force axis and the bridge axis is in the range of between about 1.0 inch and about 1.25 inches, inclusive. The preceding subject matter of this paragraph characterizes example 9 of the present disclosure, wherein example 9 also includes the subject matter according to example 8, above.

The tool head comprises at least one of a rivet gun, a drill, an impact gun, a nail gun, a flashlight, and a jack hammer. The preceding subject matter of this paragraph characterizes example 10 of the present disclosure, wherein example 10 also includes the subject matter according to any one of examples 7-9, above.

Additionally disclosed herein is a pneumatic rivet hammer. The pneumatic rivet hammer includes a handle and a rivet barrel, where the handle includes a handle region having a first end and a second end, the handle region defining a handle axis at a non-orthogonal angle to an output force axis that is defined by the rivet barrel. The handle region includes a first region adjacent the first end and adapted to receive a user's thumb and index finger, the first region including a trigger for actuating the tool head, and where the first region is substantially coaxial with the output force axis. The handle region also includes a second region adjacent the first region and adapted to receive the user's middle finger and a first portion of the user's palm. The handle region also includes a third region adjacent the second region and adapted to receive the user's ring finger and a second portion of the user's palm. The handle region also includes a fourth region disposed between the third region and the second end, and adapted to receive the user's pinky finger and a third portion of the user's palm. The preceding subject matter of this paragraph characterizes example 11 of the present disclosure.

The pneumatic rivet hammer also includes a bridge region that defines a bridge axis extending forward from the first end, and is at a non-orthogonal angle to the handle axis. The preceding subject matter of this paragraph characterizes example 12 of the present disclosure, wherein example 12 also includes the subject matter according to example 11, above.

The bridge axis is substantially parallel with the output force axis. The preceding subject matter of this paragraph characterizes example 13 of the present disclosure, wherein example 13 also includes the subject matter according to example 12, above.

A distance between the output force axis and the bridge axis is in the range of between about 1.0 inch and about 1.25 inches, inclusive. The preceding subject matter of this paragraph characterizes example 14 of the present disclosure, wherein example 14 also includes the subject matter according to any one of examples 12-13, above.

Additionally, disclosed herein is a power tool handle that includes a first end and a second end, a first region adjacent the first end and adapted to receive a user's thumb and index finger, the first region including a trigger for actuating a tool head, and where the first region is substantially coaxial with an output force axis of the tool head. The power tool handle also includes a second region adjacent the first region and is adapted to receive the user's middle finger and a first portion of the user's palm, a third region adjacent the second region and adapted to receive the user's ring finger and a second portion of the user's palm, and a fourth region disposed between the third region and the second end, and adapted to receive the user's pinky finger and a third portion of the user's palm. The preceding subject matter of this paragraph characterizes example 15 of the present disclosure.

The first region includes a rearward concave surface. The preceding subject matter of this paragraph characterizes example 16 of the present disclosure, wherein example 16 also includes the subject matter according to example 15, above.

The trigger is coupled with a forward surface of the first region. The preceding subject matter of this paragraph characterizes example 17 of the present disclosure, wherein example 17 also includes the subject matter according to any one of examples 15-16, above.

The second region includes a rearward convex surface. The preceding subject matter of this paragraph characterizes example 18 of the present disclosure, wherein example 18 also includes the subject matter according to any one of examples 15-17.

The third region includes a rearward convex surface. The preceding subject matter of this paragraph characterizes example 19 of the present disclosure, wherein example 19 also includes the subject matter according to any one of examples 15-18, above.

The fourth region includes a forward concave surface. The preceding subject matter of this paragraph characterizes example 20 of the present disclosure, wherein example 20 also includes the subject matter according to any one of examples 15-19, above.

The described features, structures, advantages, and/or characteristics of the subject matter of the present disclosure may be combined in any suitable manner in one or more examples, including embodiments and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example, embodiment, or implementation. In other instances, additional features and advantages may be recognized in certain examples, embodiments, and/or implementations that may not be present in all examples, embodiments, or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter, they are not therefore to be considered to be limiting of its scope. The subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

The apparatus and system of this disclosure provide an improvement to the conventional power tool handle. In particular, the below described examples provide an improved ergonomic handle that better aligns the arm of a user with an output force axis of the power tool to minimize injuries. Conventional rivet guns, for example, typically have an output force axis that lies above the hand grip of the conventional rivet gun resulting in a rotational torque force (an upward "jerking" motion) on the wrist of the user. Additionally, the examples of this disclosure provide a forward-facing trigger that minimizes misfires commonly associated with power tool handles where the trigger is rearwardly facing.

The power tool examples described here may be employed during any one of the steps of manufacturing, assembly, and repair of an aircraft. However, the principles of the present disclosure may be applied to other industries, such as the automotive assembly industry, or any industry that utilizes a hand-held power tool for manufacturing, assembly, and/or repair.

Figure 1:
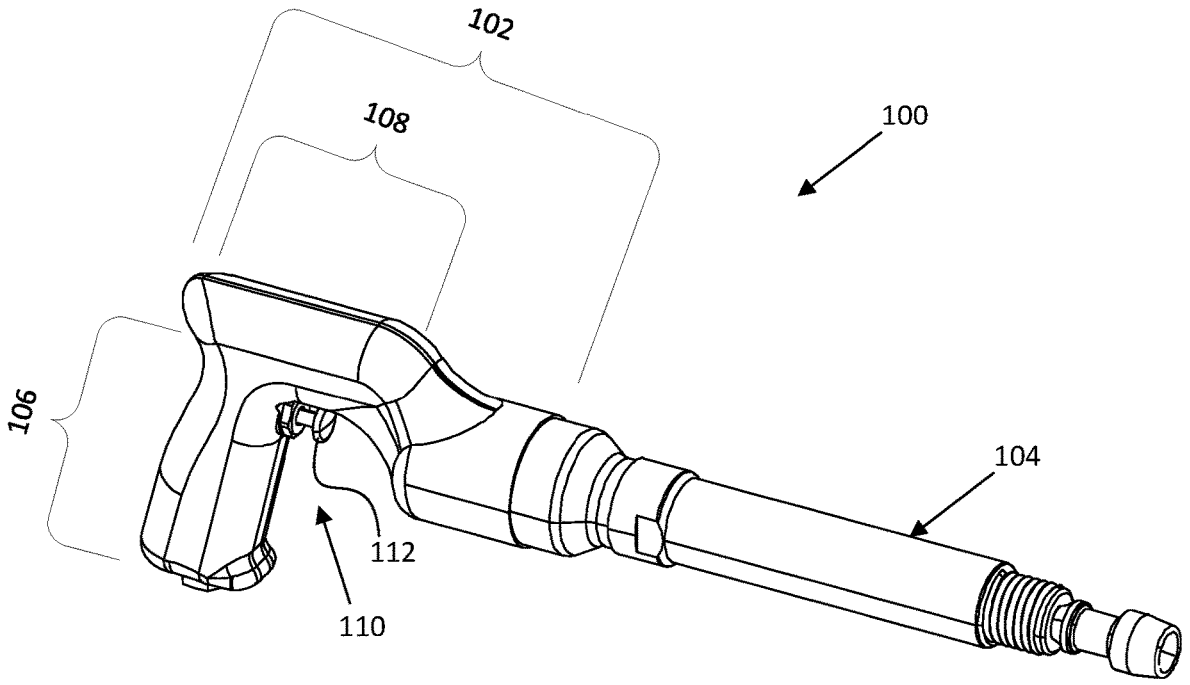
FIG. 1 is a perspective view of a power tool, according to one or more examples of the present disclosure.

FIG. 1 is a perspective view diagram illustrating one example of a power tool 100. The power tool 100, as depicted, is a rivet gun for setting rivets. The power tool 100 of the present disclosure includes a handle 102 (i.e., power tool handle) adaptable to receive various types of tool heads 104. Examples of tool heads 104 include, but are not limited to, a rivet gun that includes a rivet barrel, a rotary drill, an impact drill, a nail gun, a staple gun, a hand-held jack hammer, a chisel hammer, a flashlight, and like tool heads. Stated differently, the handle 102 may be adapted to receive any tool head 104.

The handle 102, in some examples, includes a handle region 106 coupled to a bridge region 108. The handle region 106 generally extends downward from the bridge region 108. The bridge region 108 extends from the handle region 106 forward and downward (see FIG. 2) towards the tool head 104. This "gooseneck" style configuration of the handle 102, together with the tool head 104, forms a pocket region 110 for receiving a user's hand. The user's hand grips the handle region 106 to control the power tool 100 by activating a source of motion via the trigger 112. The tool head 104 may include a pneumatic or an electric source of motion that is activated/energized by a power source. In some examples, the power source is disposed within the handle region 106 (e.g., a battery) or, in alternative examples, the power source is a remote power source that is operably coupled to the handle region 106 (e.g., via an air hose supplying compressed air via channels formed within the handle region 106). As used herein, the phrase "operably coupled" refers to a functional interaction between two or more units of the power tool 100. For example, the handle region 106 may be operably coupled to the tool head 104 so that a channel for conducting compressed air within the handle region 106 extends to the tool head 104 and drives, for example, a rivet gun.

Figure 2:
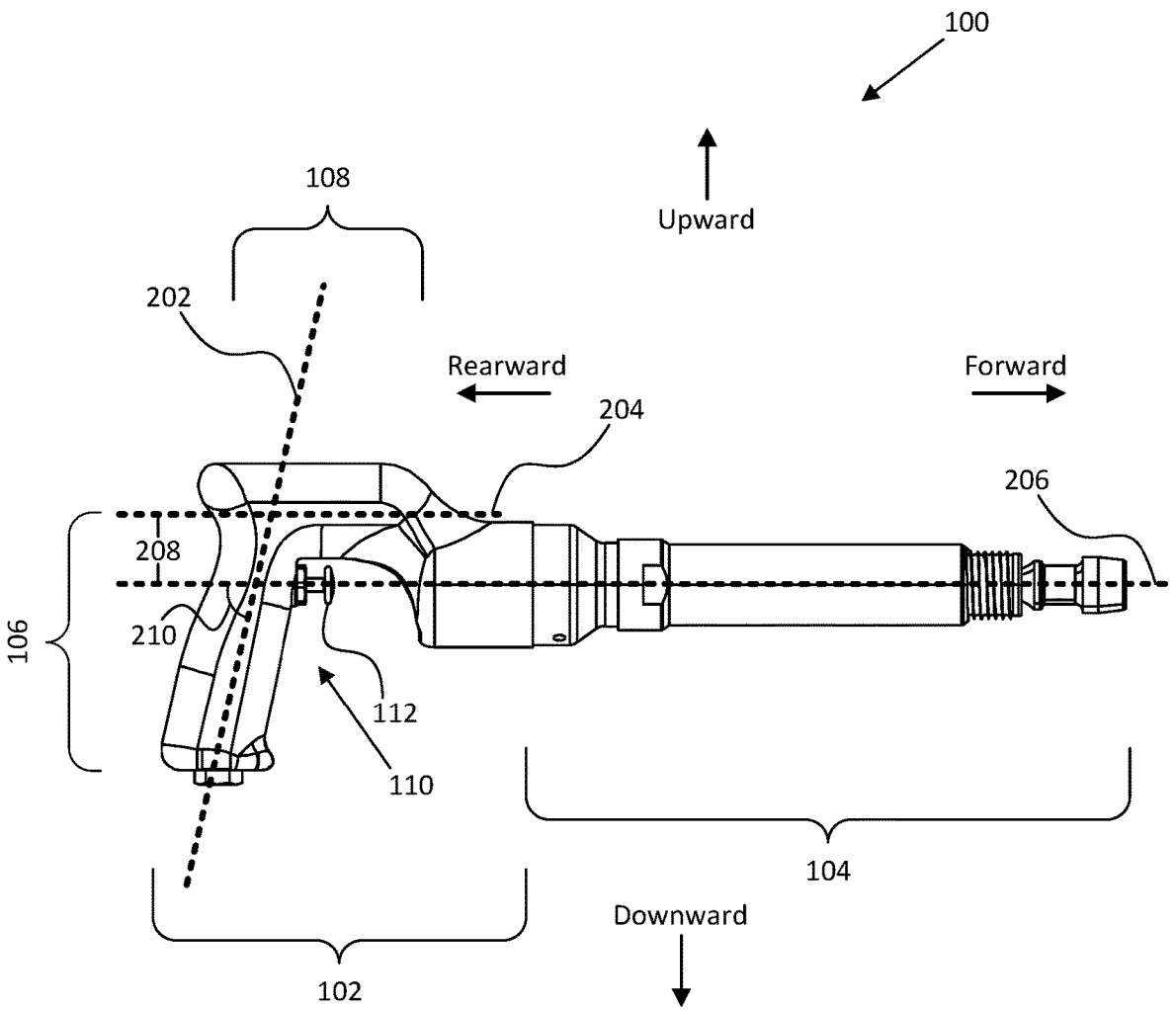
FIG. 2 is a side view of the power tool of FIG. 1, according to one or more examples of the present disclosure.

FIG. 2 is a side view diagram illustrating one example of the power tool 100. The handle 102, in some examples, is formed by the handle region 106, and the bridge region 108 as described above with reference to FIG. 1. The handle region 106 defines a handle axis 202 that extends along a length of the handle region 106. Similarly, the bridge region 108 defines a bridge axis 204. In some examples, the bridge axis 204 is substantially parallel to, but offset from, an output force axis 206 defined by the tool head 104. The output force axis 206 generally identifies a direction of force that the tool head 104 applies to a work piece. For example, if the tool head 104 is a rivet gun, the output force axis 206 identifies the direction of force that the rivet gun applies to a rivet, and a direction of a corresponding rebound force that is transmitted into an arm of the user.

The offset, or distance 208, between the output force axis 206 and the bridge axis 204, in some examples, is in the range of from about 1.0 inches to about 1.25 inches, inclusive. In other examples, the distance 208 is from about 1.0 to about 1.125 inches. This offset distance 208 allows a gooseneck configuration that aligns the user's arm with the output force axis 206 (see, e.g., FIG. 6). In some examples, this is achieved by aligning the trigger 112 with the output force axis 206. Accordingly, an index finger of the user is positioned over the trigger 112 to properly align the user's arm with the output force axis 206.

The handle region 106 of the handle 102 is ergonomically oriented with reference to the output force axis 206. The handle region 106 extends generally along the handle axis 202, which is at an angle 210 to the output force axis 206. In some examples, the angle 210 formed by the handle axis 202 and the output force axis 206 is non-orthogonal. For example, the angle 210 may be approximately 80 degrees. As used herein, the term "approximately" may encompass ranges of up to ±10% of the referenced value. In another example, the angle 210 is in the range of between about 78 degrees and about 82 degrees. The angle 210, it should be understood, may be varied among a wide range of angles.

To aid in the discussion of the configuration of the power tool 100, FIG. 2 has been labeled with directional arrows Forward, Rearward, Upward, and Downward. Forward generally points towards a work piece (i.e., a rivet) that the power tool impacts. Rearward generally points in the opposite direction.

Figure 3:
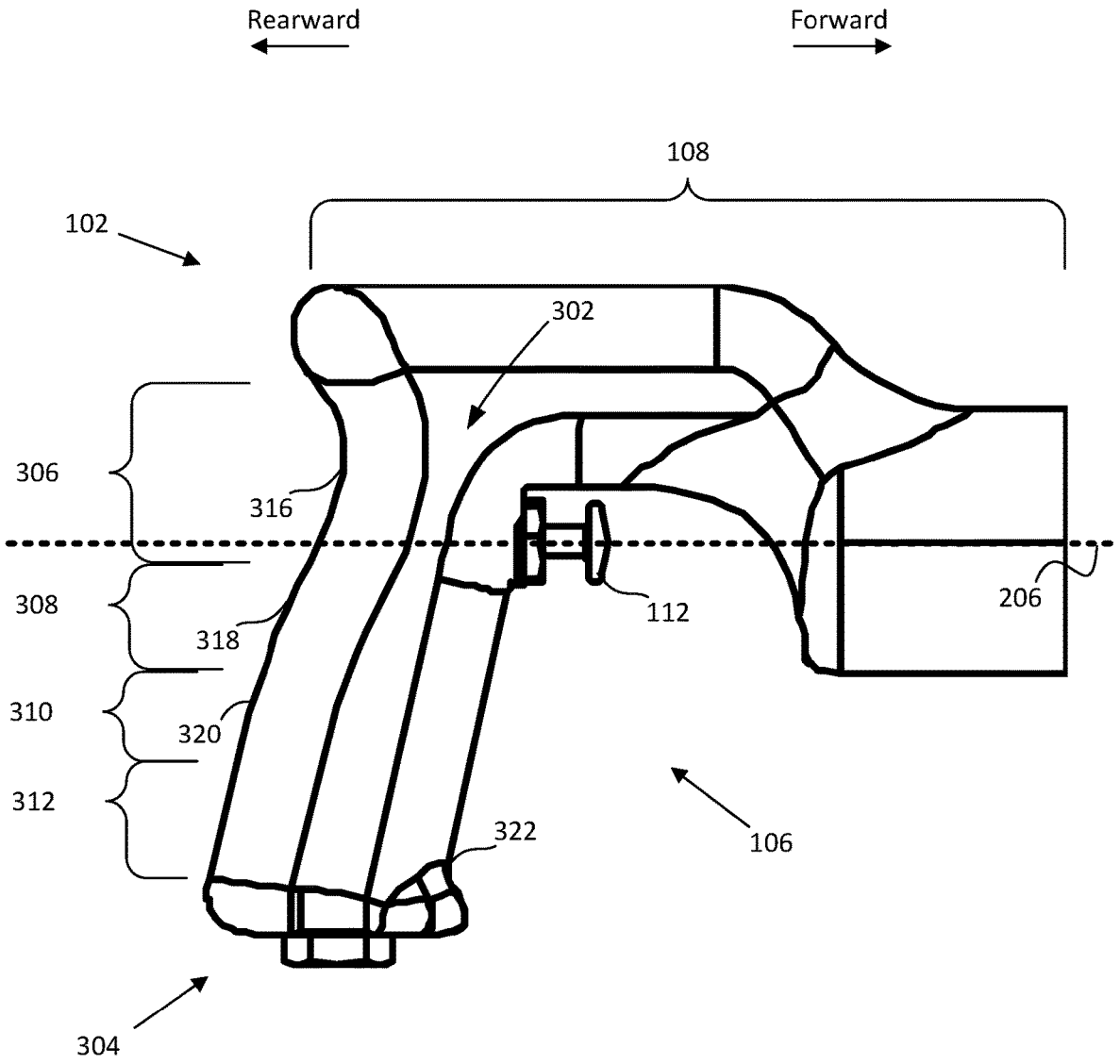
FIG. 3 is a side view of a handle of a power tool, according to one or more examples of the present disclosure.

FIG. 3 is a side view diagram illustrating one example of the handle 102. The handle 102 is formed by the handle region 106 and the bridge region 108. The handle region has a first end 302 (or proximal end) coupled to the bridge region 108 and a second end 304 (or distal end). The handle 102 may be formed as a single, unitary component, or alternatively as separable handle and bridge regions. The bridge region 108 extends forward from the handle region 106 for a distance along the bridge axis 204 (see FIG. 2) before extending downward towards the output force axis (see FIG. 2).

The handle region 106, in some examples, includes a first region 306, a second region 308, a third region 310, and a fourth region 312. Each of these regions is configured to receiver a finger of the user. For example, the first region 306 is adapted to receive a thumb and an index finger of the user. The first region includes the trigger 112. Stated differently, the trigger 112 may be disposed on a forward-facing surface of the first region 306. A rearward-facing surface of the first region 306 may be a rearward concave surface 316 adapted to engage the webbing of the user's hand. The index finger of the user actuates the trigger 112 which activates the tool head. The first region 306 is disposed adjacent and below the bridge region 108.

The second region 308 of the handle region 106 is disposed adjacent the first region 306 and is adapted to receive the user's middle finger. The second region 308 may have a substantially planar forward-facing surface as depicted. This planar forward-facing surface may extend downward from the trigger 112 towards the second end 304 of the handle region 106. Alternatively, the forward-facing surface may include concave regions for the user's fingers to engage. The second region 308, in some examples, includes a rearward convex surface 318 that engages a portion of the user's palm.

The third region 310 of the handle region 106 is disposed adjacent and below the second region 308. The third region 310 is configured to receive the user's ring finger. A rearward-facing surface of the third region 310 may be convex (e.g., rearward convex surface 320 that is an extension of rearward convex surface 318.

The fourth region 312 of the handle region is configured to receive the user's pinky finger. The fourth region 312 is disposed adjacent to and below the third region 310. The fourth region 312 includes a forward concave surface 322. It should be understood that the positions of the user's fingers within the respective regions are approximations and may vary depending on the size of the user's hand.

Figure 4:
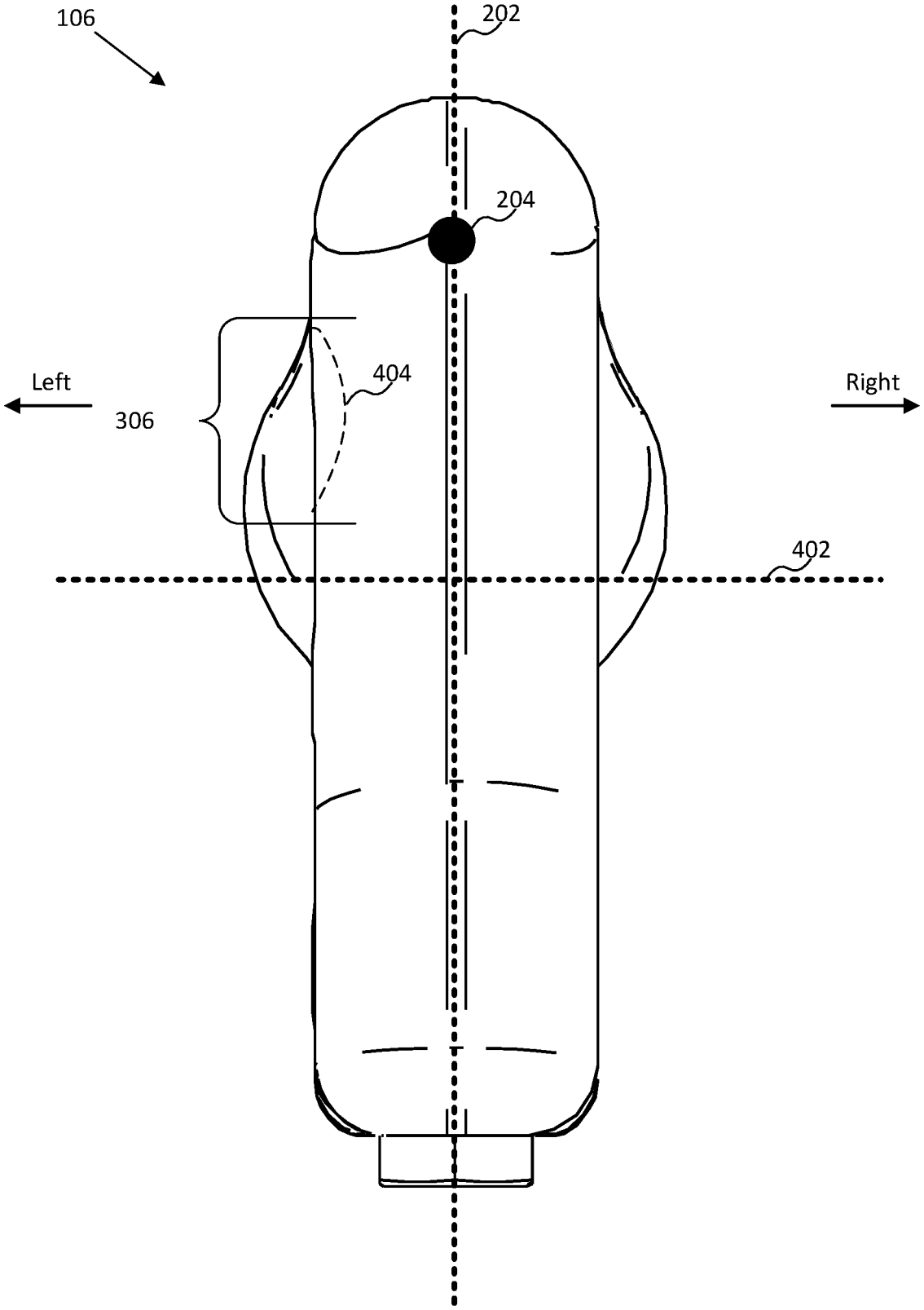
FIG. 4 is a rear view of a handle region of a power tool, according to one or more examples of the present disclosure.

FIG. 4 is a rear-view diagram illustrating one example of the handle region 106. As described previously, the handle region 106 defines the handle axis 202 that extends lengthwise through the handle region 106. The handle axis 202 intersects the bridge axis 204, which in FIG. 4 extends into and out of FIG. 4. A lateral axis 402 intersects with the handle axis 202 and extends to the right and left of the handle region 106, and subsequently the power tool 100.

The handle region 106 may be substantially symmetric with respect to a plane that is defined in one direction by the handle axis 202 and in a second direction by the bridge axis 204. In other words, the features of the handle region to the right side of the handle axis 202 are a mirror reflection of the features of the left side. Accordingly, the handle region 106 is adapted for ambidextrous use. Alternatively, the handle region 106 may be shaped in a right-handed or left-handed configuration. For example, for a right-handed user, the first region 306 may include an indentation 404 or groove on the left side for receiving the thumb of the user. Similarly, the reverse may be implemented for a left-handed user with an indentation on the right side.

Figure 5:
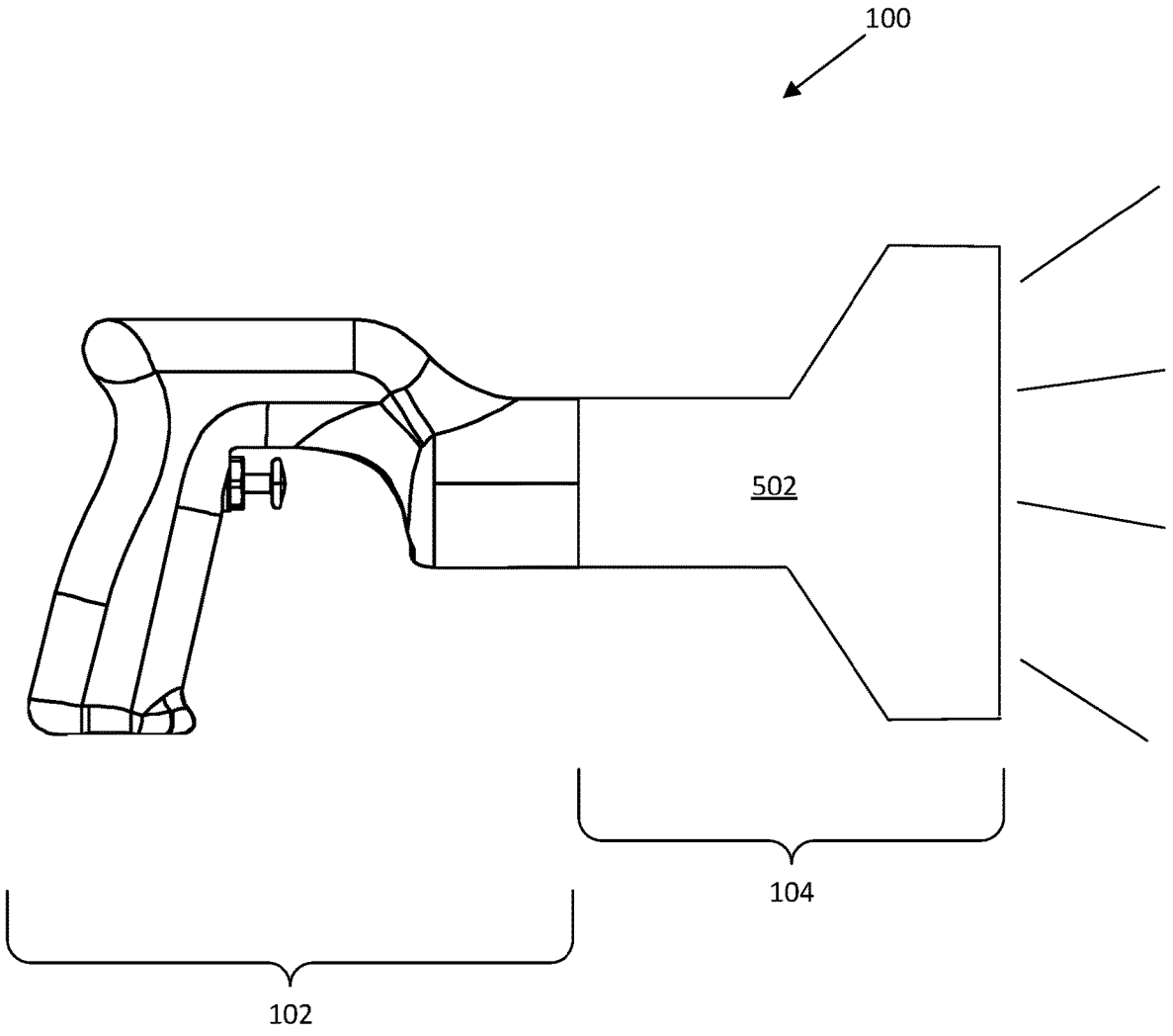
FIG. 5 is a side view of a power tool, according to one or more examples of the present disclosure.

FIG. 5 is a side-view diagram illustrating another example of the power tool 100. The power tool 100, as described previously, is configured to receive various types of tool heads 104. By way of example, FIG. 5 depicts a flashlight 502 operably coupled to the handle 102. The handle 102, in this example, contains a power source (i.e., a battery) for energizing the flashlight 502. The trigger 112 actuates the flashlight. The flashlight is given by way of example only, as it is contemplated that the "gooseneck" handle 102 of the present disclosure is adaptable to couple to various different tool heads 104 including, but not limited to, power drills, stapler guns, nail guns, hand-held jack hammers, impact drills, rotary drills, grinders, and like tools. The trigger 112 is adaptable to actuate each of these.

Figure 6:
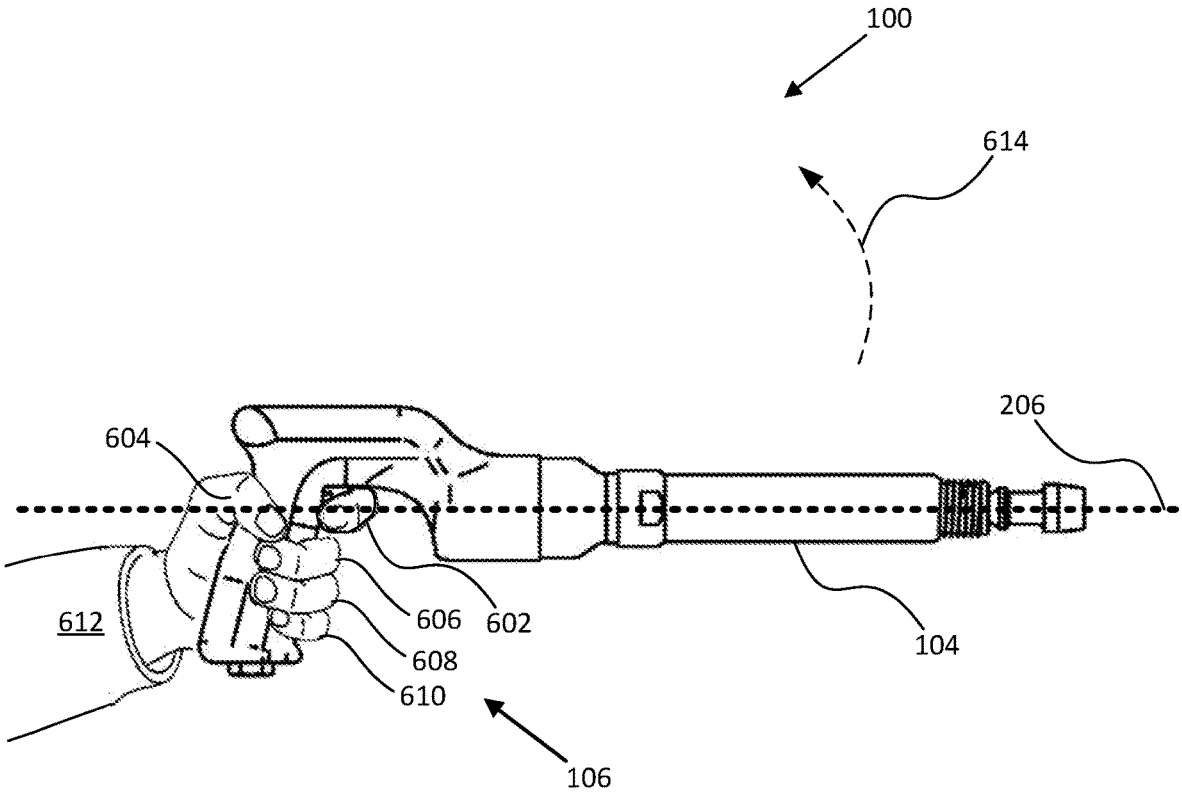
FIG. 6 is a side view of a power tool, according to one or more examples of the present disclosure.

FIG. 6 is a side-view diagram illustrating one example of the power tool 100 according to one or more examples of the present disclosure. The power tool 100, as described, is configured to receive a hand of a user at an ergonomic angle of approximately 80 degrees with reference to the output force axis of the tool head 104. The gooseneck shape of the handle 102 aligns an index finger 602 and thumb 604 with the output force axis 206. The first-fourth regions (see FIG. 3) of the handle region 106 are each adapted to receive the fingers (i.e., index finger 602, thumb 604, middle finger 606, ring finger 608, and pinky 610).

Beneficially, this configuration allows a rebound force to transmit through the handle 102 to an arm 612 of the user along the output force axis 206. Convention power tool handles, with the output force axis 206 above the first region or trigger region, cause the convention power tool to apply a rotational torque on the arm, depicted by arrow 614. This undesirable rotational torque force causes injuries to the user.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A handle for use with a tool head, where the tool head defines an output force axis, the handle comprising:

a handle region having a first end and a second end, the handle region defining a handle axis, along a longitudinal axis of the handle region, at a non-orthogonal angle to the output force axis, where the handle region comprises:

a first region adjacent the first end and adapted to receive a user's thumb and index finger, the first region including a trigger for actuating the tool head, and where the first region is aligned with the output force axis, such that the trigger is coaxial with the output force axis;

a second region adjacent the first region and adapted to receive a user's middle finger and a first portion of a user's palm;

a third region adjacent the second region and adapted to receive a user's ring finger and a second portion of the user's palm; and a fourth region disposed between the third region and the second end, and adapted to receive a user's pinky finger and a third portion of the user's palm; and a bridge region coupled to the handle region and comprising a first section, defining a bridge axis, extending from the first end of the handle region to an intermediate location, and a second section, extending downwardly at a non-orthogonal angle toward the output force axis from the intermediate location to a distal end of the bridge region;

wherein an open pocket region is formed between the handle region and the bridge region and the trigger is within the open pocket region.

2. The handle of claim 1, where the first region further comprises a rearward concave surface.

3. The handle of claim 2, where the trigger is coupled with a forward surface of the first region.

4. The handle of claim 1, where the second region further comprises a rearward convex surface.

5. The handle of claim 1, where the third region further comprises a rearward convex surface.

6. The handle of claim 1, where the fourth region further comprises a forward concave surface.

7. The handle of claim 1, where the bridge axis is at a non-orthogonal angle to the handle axis.

8. The handle of claim 7, where the bridge axis is substantially parallel with the output force axis.

9. The handle of claim 8, where a distance between the output force axis and the bridge axis is in a range of from 1.0 inch and 1.25 inches, inclusive.

10. The handle of claim 7, where the tool head is a rivet gun, a drill, an impact gun, a nail gun, a flashlight, or a jack hammer.

11. A pneumatic rivet hammer, comprising:

a handle and a rivet barrel, where the handle comprises:

a handle region having a first end and a second end, the handle region defining a handle axis, along a longitudinal axis of the handle region, at a non-orthogonal angle to an output force axis that is defined by the rivet barrel, where the handle region comprises:

a first region adjacent the first end and including a trigger for actuating the rivet barrel and a rearward concave surface, and where the first region is aligned with the output force axis, such that the trigger is coaxial with the output force axis;

a second region adjacent the first region and including a rearward convex surface;

a third region adjacent the second region and including a rearward convex surface; and a fourth region disposed between the third region and the second end and including a forward concave surface; and a bridge region coupled to the handle region and comprising a first section, defining a bridge axis, extending from the first end of the handle region to an intermediate location, and a second section, extending downwardly at a non-orthogonal angle toward the output force axis from the intermediate location to a distal end of the bridge region;

wherein an open pocket region is formed between the handle region and the bridge region and the trigger is within the open pocket region.

12. The pneumatic rivet hammer of claim 11, where the bridge axis is at a non-orthogonal angle to the handle axis.

13. The pneumatic rivet hammer of claim 12, where the bridge axis is substantially parallel with the output force axis.

14. The pneumatic rivet hammer of claim 12, where a distance between the output force axis and the bridge axis is in a range of from 1.0 inch to 1.25 inches, inclusive.

15. A power tool handle, comprising:

a handle region having a first end and a second end and defining a handle axis, along a longitudinal axis of the handle region, the handle region comprising:

a first region adjacent the first end and adapted to receive a user's thumb and index finger, the first region including a trigger for actuating a tool head, and where the first region is aligned with an output force axis defined by the tool head, such that the trigger is coaxial with the output force axis;

a second region adjacent the first region and adapted to receive a user's middle finger and a first portion of a user's palm;

a third region adjacent the second region and adapted to receive a user's ring finger and a second portion of the user's palm; and a fourth region disposed between the third region and the second end, and adapted to receive a user's pinky finger and a third portion of the user's palm; and a bridge region coupled to the handle region and comprising a first section, defining a bridge axis, extending from the first end of the handle region to an intermediate location, and a second section, extending downwardly at a non-orthogonal angle toward the output force axis from the intermediate location to a distal end of the bridge region;

wherein an open pocket region is formed between the handle region and the bridge region, and the trigger is within the open pocket region.

16. The power tool handle of claim 15, where the first region further comprises a rearward concave surface.

17. The power tool handle of claim 15, where the trigger is coupled with a forward surface of the first region.

18. The power tool handle of claim 15, where the second region further comprises a rearward convex surface.

19. The power tool handle of claim 15, where the third region further comprises a rearward convex surface.

20. The power tool handle of claim 15, where the bridge axis is substantially parallel with the output force axis.

* * * * *